US011408153B1

(12) United States Patent
Mason

(10) Patent No.: US 11,408,153 B1
(45) Date of Patent: Aug. 9, 2022

(54) MULTI-PORT TRANSITION TEE DRAIN VALVE

(71) Applicant: NIBCO Inc., Elkhart, IN (US)

(72) Inventor: Christopher W. Mason, Granger, IN (US)

(73) Assignee: NIBCO INC., Elkhart, IN (US)

( * ) Notice: Subject to any disclaimer, the term of this patent is extended or adjusted under 35 U.S.C. 154(b) by 0 days.

(21) Appl. No.: 17/149,788

(22) Filed: Jan. 15, 2021

(51) Int. Cl.
*E03B 9/14* (2006.01)

(52) U.S. Cl.
CPC ..... *E03B 9/14* (2013.01)

(58) Field of Classification Search
CPC ..... E03B 9/14
USPC ..... 137/203
See application file for complete search history.

(56) References Cited

U.S. PATENT DOCUMENTS 3,333,699 A * 8/1967 Bliss ..... F16K 11/00 210/136
4,129,149 A * 12/1978 Brehmer ..... F16K 11/00 285/124.1
5,433,243 A * 7/1995 Griswold ..... B01D 35/157 137/498
8,375,991 B2 2/2013 Erhardt
8,522,814 B2 9/2013 Kempf et al.
8,770,223 B2 7/2014 Reck
9,061,223 B2 6/2015 Winborn
2008/0314466 A1 12/2008 Cimberio et al.
2010/0018911 A1* 1/2010 VanZeeland ..... E03B 1/04 210/417
2019/0032801 A1 1/2019 Andersson

FOREIGN PATENT DOCUMENTS

GB 2509714 7/2014

OTHER PUBLICATIONS

Webstone, Pro-Pal Series, Primary Secondary Purge Tee, www.webstonevalves.com/default.aspx?page=customer&file=customer/wecoin/customerpages/purgetee.htm (2020).

* cited by examiner

*Primary Examiner* — Kevin R Barss
(74) *Attorney, Agent, or Firm* — Price Heneveld LLP

(57) ABSTRACT

A multi-port transition tee drain valve includes multiple ports that are positioned generally perpendicular to the body of the fitting that includes a drain valve. The drain valve includes a drain port positioned next to a valve member which can be opened to permit the draining of the multi-port transition tee drain valve and surrounding components through the drain port. The fittings on the ports and the fittings on the end(s) of the drain body can be different to permit the transition of one type or size of tubing/piping to another.

20 Claims, 9 Drawing Sheets

MULTI-PORT TRANSITION TEE DRAIN VALVE

BACKGROUND OF THE INVENTION

The present invention relates to a drain valve. Valves incorporating drains can be used to drain all or part of the plumbing components near the drain valve. Drain valves can be used in a variety of plumbing applications, including, but not limited to, potable plumbing or hydronic heating systems. Drain valves that are incorporated into a system typically permit draining either above or below the valve by a drain segment that was positioned, as a separate component, above or below the drain valve. A number of components are typically necessary to couple a drain, a valve, and other piping unions when branch assemblies lead to and from the valve. This typically includes at least one segment of piping in between the drain, valve, piping union, and/or additional other components. This creates additional leak paths, takes additional time to assemble, and takes space given the number of components especially when transitioning from one type of size of tubing/piping to another. In addition, multiple components are typically necessary when there are multiple inlet and/or outlet fittings near the drain port.

An improved assembly that eliminates a number of components and potential leak paths and provides multiple inlet and/or outlet ports while saving assembly time, labor, and space, is described herein.

SUMMARY OF THE INVENTION

One aspect of the present invention is a multi-port tee drain valve. The multi-port tee drain valve includes a fitting body having a first end portion, a second end portion, a fluid passageway extending between the first end portion and the second end portion, and at least two ports located between the first end portion and the second end portion. The ports are positioned generally perpendicular to the fluid passageway of the fitting body. The multi-port tee drain valve also includes a drain port located in the first end portion, a first fitting located at the second end portion, and a valve member located in the first end portion that is positioned between the drain port and the ports. The ports have fitting ends.

Another aspect of the present invention is a drain valve assembly. The drain valve assembly includes a drain valve body having a first end portion with a drain port, a second end portion with a first fitting end, and a fluid passageway extending between the first end portion and the second end portion. The drain valve body also includes at least two ports located between the first end portion and the second end portion, with the ports being positioned generally perpendicular to the fluid passageway. The drain valve assembly includes a valve member that is located in the first end portion between the drain port and the ports. The ports have fitting ends.

Yet another aspect of the present invention is a multi-port transition tee drain valve. The multi-port transition tee drain valve includes a drain valve body having a first end portion with a drain port, a second end portion with a first fitting end, and a fluid passageway extending between the first end portion and the second end portion. The drain valve body also has at least two ports located between the first end portion and the second end portion. The ports are positioned generally perpendicular to the fluid passageway. The multi-port transition tee drain valve also includes a valve member located in the first end portion between the drain port and the ports. The ports have fitting ends that are different than the first fitting end of the second end portion of the drain valve body.

These and other features, advantages, and objects of the present invention will be further understood and appreciated by those skilled in the art by reference to the following specification, claims, and appended drawings.

DETAILED DESCRIPTION

For purposes of description herein, the terms "upper," "lower," "right," "left," "rear," "front," "vertical," "horizontal," and derivatives thereof shall relate to the invention as oriented in FIGS. 1-7. However, it is to be understood that the invention may assume various alternative orientations and step sequences, except where expressly specified to the contrary. Indeed, other exemplary orientations are shown in the Figures. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Detailed embodiments of the present invention are disclosed herein, however, it is to be understood that the disclosed embodiments are merely exemplary of the invention, which may be embodied in various forms. Therefore, specific functional or structural details disclosed herein are not to be interpreted as limiting, but merely as a basis for the claims and as a representative basis for teaching one skilled in the art to variously employ the present invention in virtually any appropriately detailed embodiment.

Figure 1:
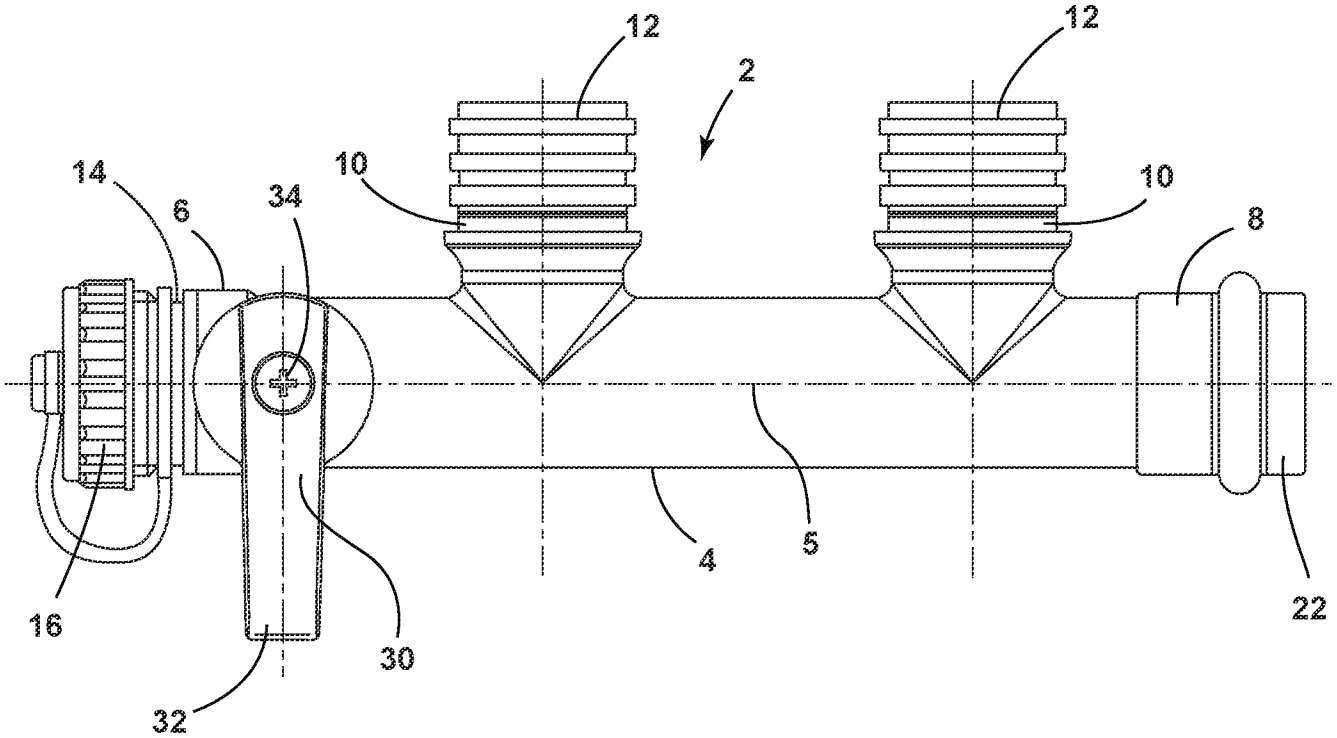
FIG. 1 is a front view of one embodiment of a multi-port transition tee drain valve.

By way of overview, the present invention is generally directed to a multi-port transition tee drain valve 2, as shown in FIG. 1. The multi-port transition tee drain valve 2 includes a body 4 having a first end portion 6 and a second end portion 8. A fluid passageway 5 extends from the first end portion 6 to the second end portion 8. The body 4 also includes a number of ports 10. The ports 10 are positioned generally perpendicular to the fluid passageway 5 thus forming a multi-port tee when multiple ports 10 are used on the body 4.

The first end portion 6 includes a drain port 14, as illustrated in FIG. 1. Drain port 14 can be closed with a cap 16, as illustrated in FIG. 1. The cap 16 can be pressed onto the drain port 14 or other mechanisms can be used to couple the cap 16 to drain port 14, including, but not limited to, the use of threaded surfaces in the drain port 14 and cap 16.

The second end portion 8 includes a first fitting end 22. In the illustrated embodiment of FIGS. 1-3 and 8, the first fitting end 22 is a press fitting. The first fitting end 22 can be any type of fitting, including, but not limited to, PEX, female pipe thread, male pipe thread, traditional solder, push-to-connect, press-to-connect, fusion, etc.

Figure 2:
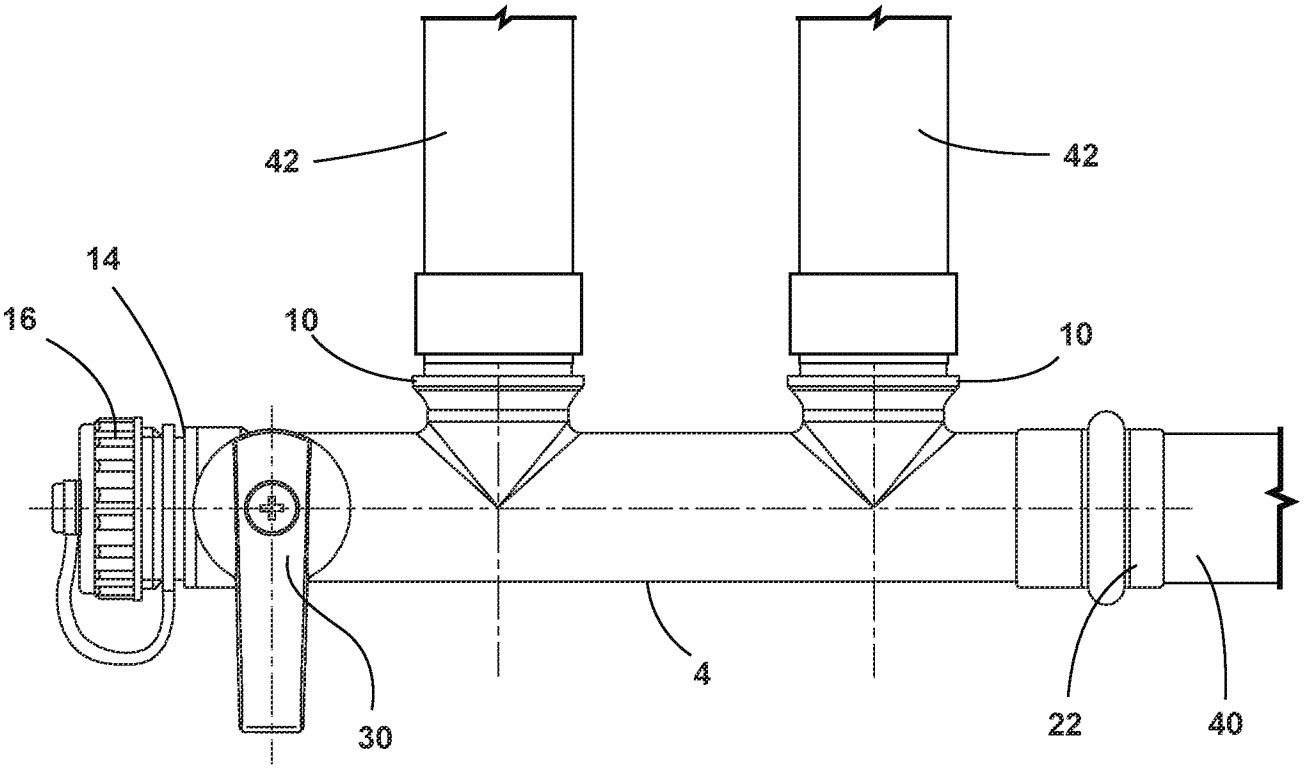
FIG. 2 is a front view of the multi-port transition tee drain valve shown in FIG. 1 coupled to tubing.

The ports 10 include fitting ends 12. The fitting ends 12 can be any type of fitting end. In the illustrated embodiment, the fitting end 12 is a PEX fitting end. However, any type of fitting end can be used for the fitting end 12 on ports 10. This includes, but is not limited to, female pipe thread, male pipe thread, traditional solder, push-to-connect, press-to-connect, fusion, etc. In the illustrated embodiment of FIGS. 1-3 and 8, the ports 10 include a PEX fitting, while the second end portion 8 includes a press fitting. This, thus, allows the transition of different types of fittings and/or different types or sizes of tubing/piping on the multi-port transition tee drain valve 2. As illustrated in FIG. 2, the tubing 42 can be connected to the fitting 12 on ports 10, while a different type of piping 40 can be connected to the first fitting end 22 of the second end portion 8 of the body 4. In the embodiment shown in FIGS. 2 and 3, the tubing 42 is PEX tubing and the piping 40 is copper piping. Other types of tubing or piping can be used depending upon the fittings that are present on the body 4.

Figure 8:
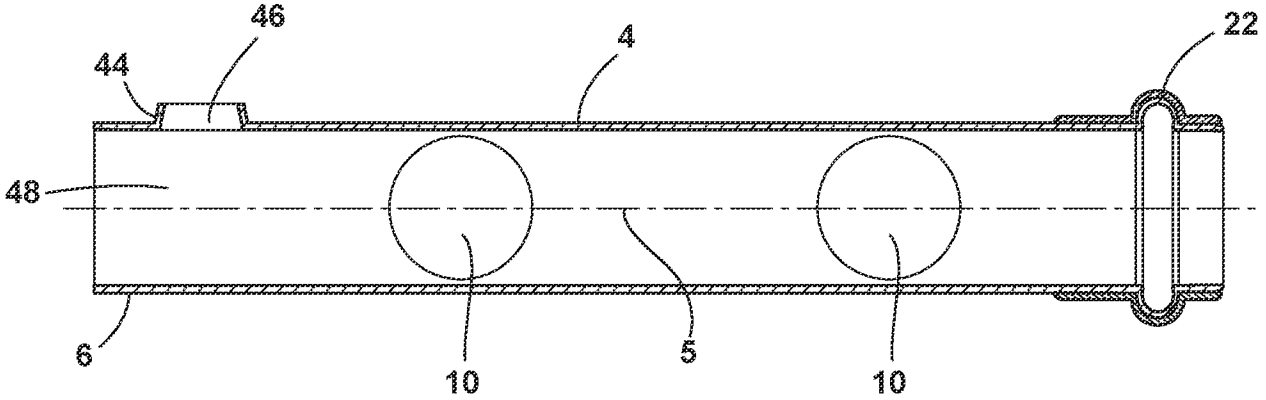
FIG. 8 is a rotated cross-sectional view of the drain valve body of the multi-port transition tee drain valve shown in FIG. 1.

A valve member 30 is located at the first end portion 6 of the body 4 in the embodiment illustrated in FIGS. 1-3 and 6. The valve member 30 includes a handle 32 that is secured to a stem (not shown) by fastener 34. The valve member 30 opens and closes the fluid passageway 5 in the first end portion 6 near the drain port 14. Thus, the valve member 30 can be opened to permit the draining of the multi-port transition tee drain valve 2 and some of the associated tubing/piping (40, 42) and potentially other close components within the plumbing system by the opening of valve member 30 and the removal of cap 16. The body 4 can include an integral valve housing 44 that includes a stem opening 46 formed within the body 4, as illustrated in FIG. 8. This permits the insertion of a ball (not shown) into the fluid passageway 5 below the stem opening 46. The ball can be seated in the ball seating area 48 through the use of seals (not shown) that engage surfaces on the body 4. A stem is inserted through stem opening 46 and coupled to the ball and the handle 32 is coupled to the stem to create the valve member 30. FIGS. 1-3 and 8 illustrate an embodiment wherein the valve housing 44 for the valve member 30 is formed integrally with the body 4 of the multi-port transition tee drain valve 2. Thus, the body 4 can be a single unitary piece. However, the valve housing 44 and drain port 14 could be part of a separate piece(s) that is coupled to the remainder of the body 4. The body 4 can be made from any material, including, but not limited to, brass.

Figure 3:
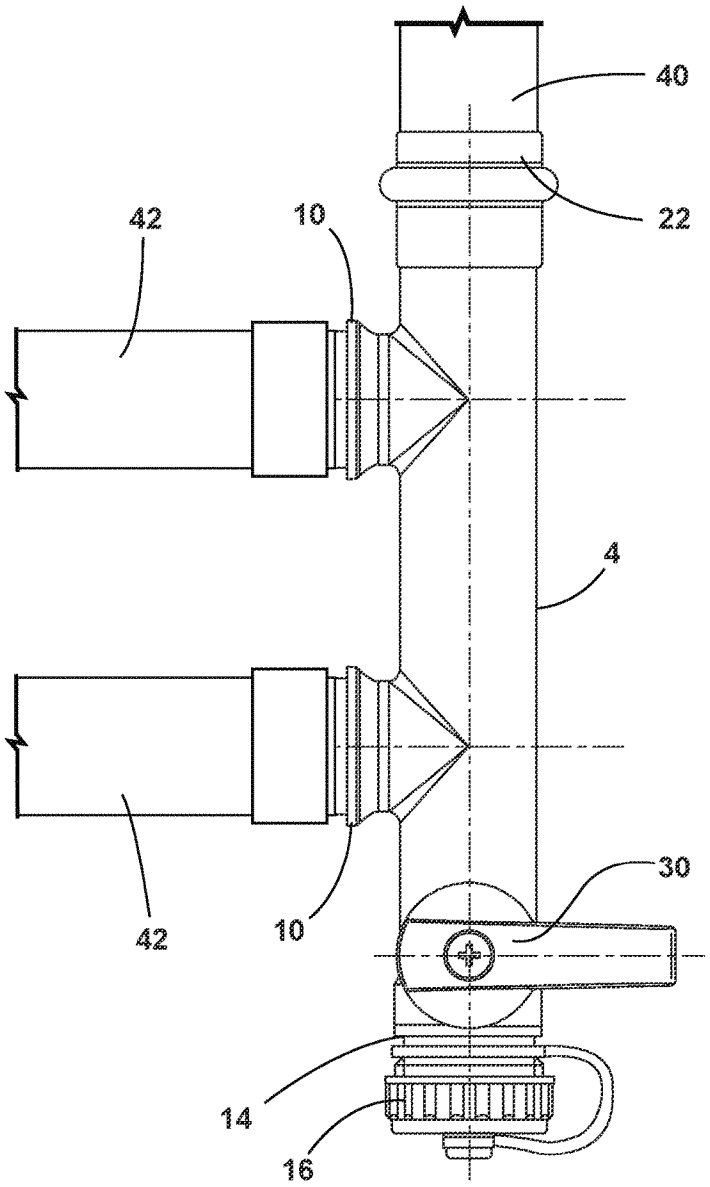
FIG. 3 is a front view of the multi-port transition tee drain valve shown in FIG. 1, oriented with the drain port in a generally vertical orientation, coupled to tubing.

While the embodiment illustrated in FIGS. 1-3 and 8 illustrate two ports 10, three or more ports 10 can also be utilized with the multi-port transition tee drain valve 2. In addition, while the embodiment illustrated in FIGS. 1-3 shows the handle 32 on the side of the body 4 while the ports 10 are on the upper surface of the body 4, the valve member 30 can be positioned such that the handle is on the same side (top) of the body 4 as the ports 10, on the opposite side (bottom) of the body 4 as the ports 10, or on the other side of the body 4. The alternative positions of the valve member 30 on the body 4 with respect to the ports 10 gives different options for installation. For example, the positioning of the valve member 30 in one of the alternative positions on the body 4 may make it easier to access the handle 32 depending upon surrounding piping, plumbing components, appliances, or other objects that create space and/or accessibility issues.

Figure 4:
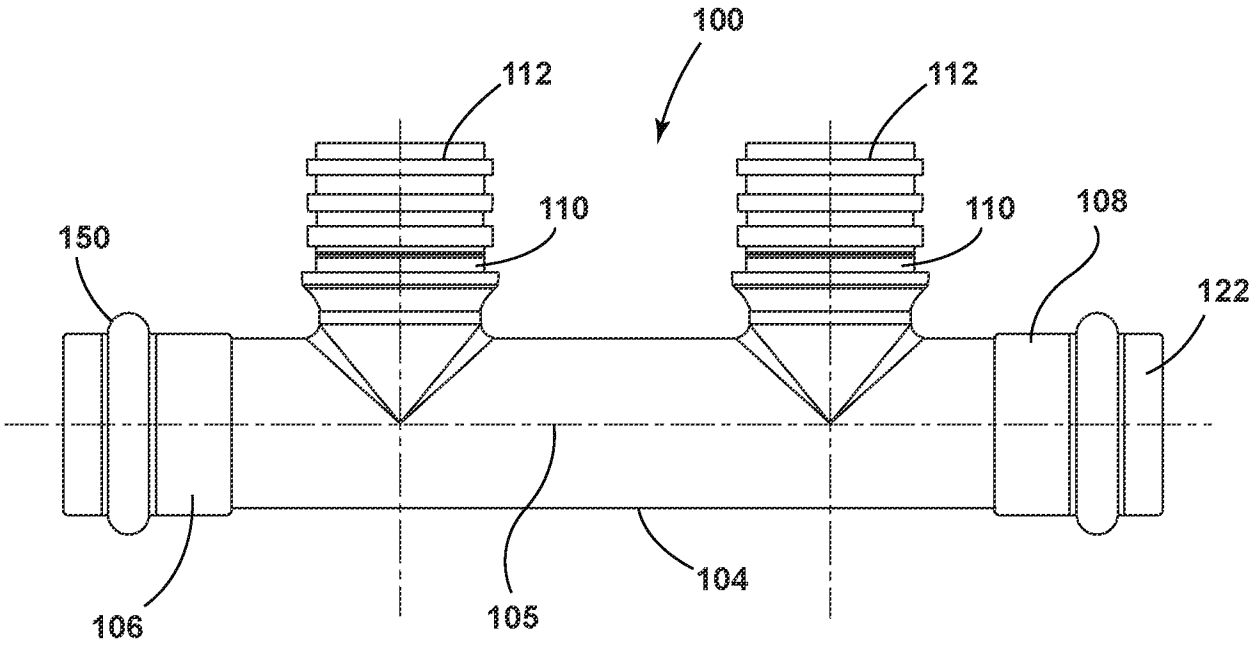
FIG. 4 is a front view of an embodiment of a multi-port transition tee that does not have a drain port or valve member.

An embodiment of a multi-port transition tee 100 is illustrated in FIG. 4. This multi-port transition tee 100 is similar to the multi-port transition tee drain valve 2 shown in FIGS. 1-3 without a drain port 14 or a valve member 30. The body 104 includes a first fitting end 122 on the second end portion 108 and a second fitting end 150 on the first end portion 106, with two ports 110 that are perpendicular to the fluid passageway 105 extending between the first fitting end 122 and the second fitting end 150. In the embodiment illustrated in FIG. 4, the first fitting end 122 and the second fitting end 150 are the same type of fitting. In the illustrated embodiment, the first fitting end 122 and the second fitting end 150 are both press fittings. However, other types of fittings can be used. The ports 110 having fitting ends 112 that are PEX fitting ends. However, other types of fittings can be used.

Figure 5:
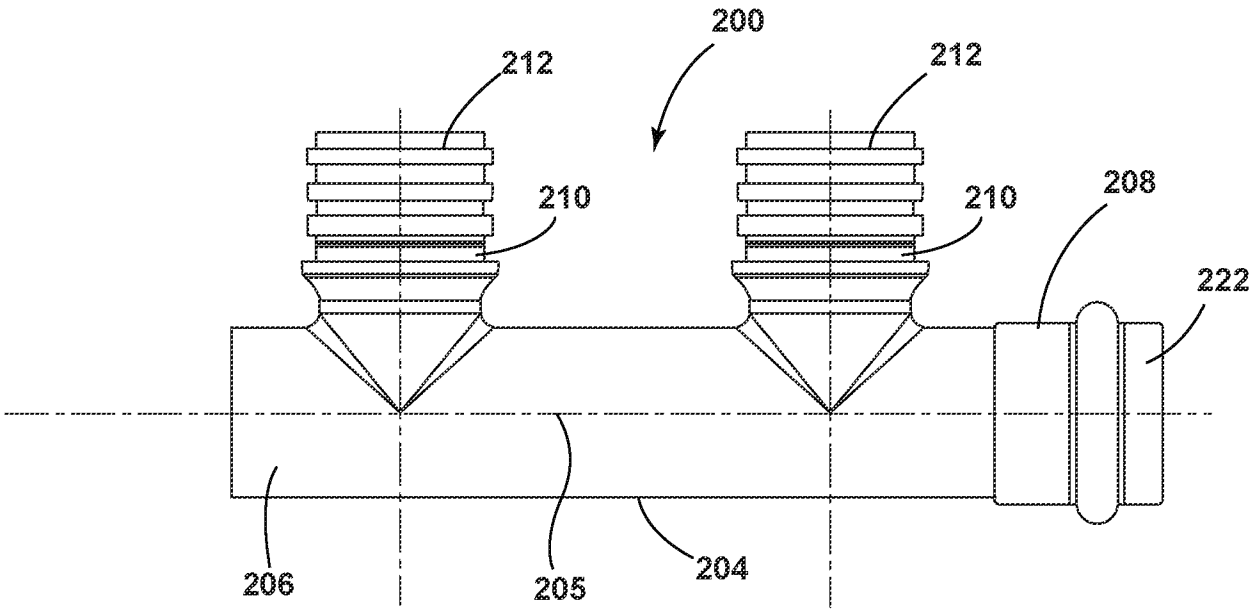
FIG. 5 is a front view another embodiment of a multi-port transition tee.

FIG. 5 illustrates an alternative embodiment of a multi-port transition tee 200 wherein the body 204, having fluid passageway 205, does not include a second fitting end at the first end portion 206. The illustrated embodiment has a first fitting end 222 at the second end portion 208 and fitting ends 212 on ports 210. Again, the fittings (222, 212) can be any type of fitting, including those that permit the transition from different types and/or sizes of tubing or piping.

Figure 6:
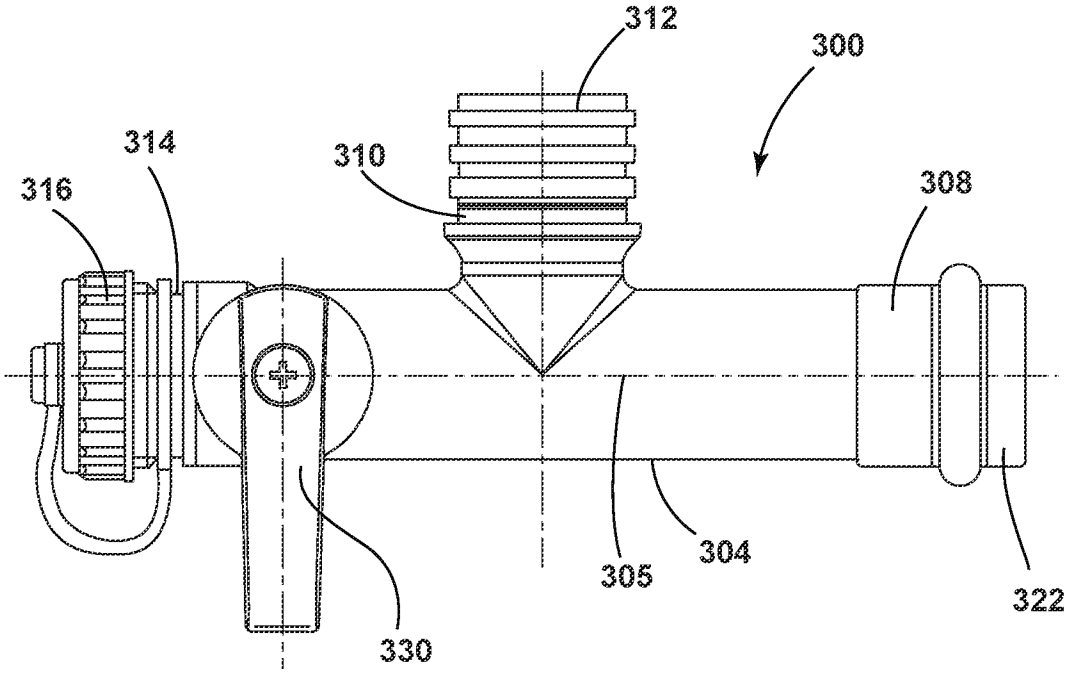
FIG. 6 is a front view of an embodiment of a single port transition tee drain valve.

FIG. 6 illustrates a single port transition tee drain valve 300. The single port transition tee drain valve 300 with fluid passageway 305 is similar to the multi-port transition tee drain valve 2, illustrated in FIGS. 1-3, with the exception of there being a single port 310. As illustrated in FIG. 6, the single port 310 includes a fitting end 312 that is different from the first fitting end 322 on the second end portion 308 on the body 304, thus permitting a transition for different types or sizes of tubing/piping. The single port transition tee drain valve 300 includes a drain port 314 with a removable cap 316 adjacent to a valve member 330.

Figure 7:
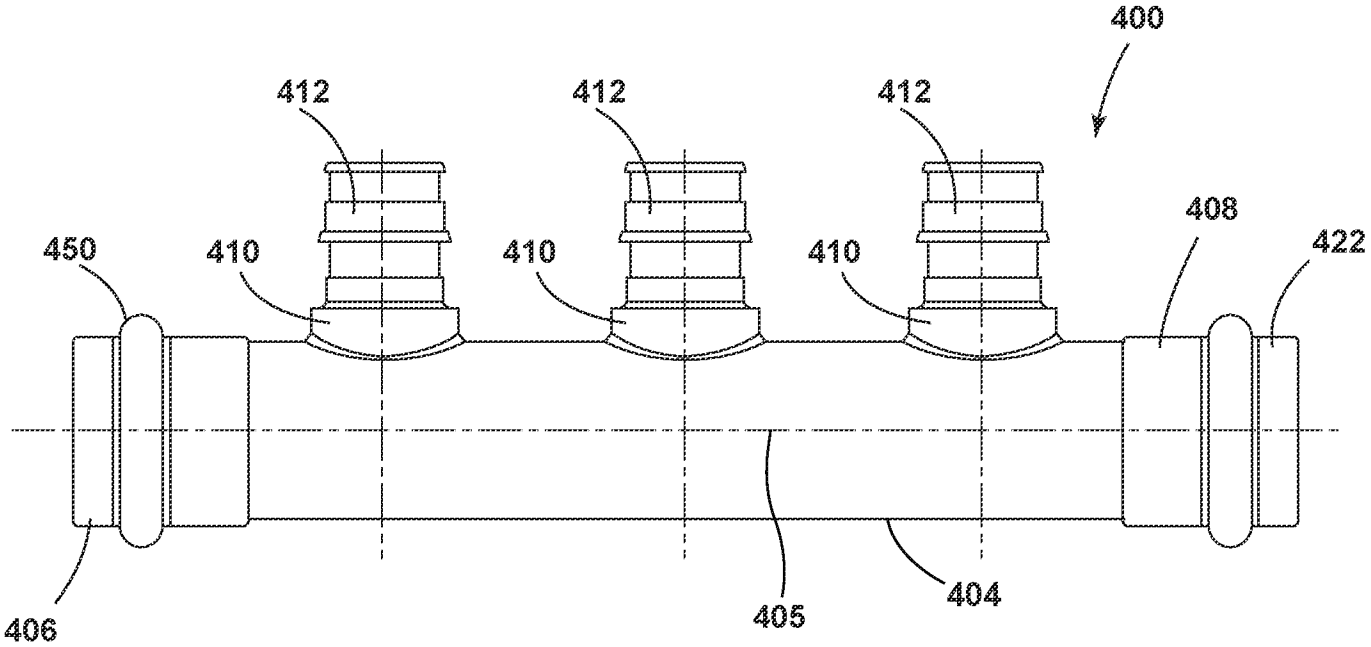
FIG. 7 is a front view of a multi-port transition tee.

FIG. 7 illustrates a multi-port transition tee 400 with body 404 with three ports 410. The three ports 410 are positioned generally perpendicular to the fluid passageway 405 between the first end portion 406 and the second end portion 408. The fittings include a first fitting end 422 on the second end portion 408, a second fitting 450 on the first end portion 406, and fittings 412 on ports 410. Again, any type of fitting can be used on fittings 412, 450, and 422, including those that permit the transition between different sizes and/or types of tubing or piping.

While the illustrated embodiments show ports (10, 110, 210, 310, 410) all having the same type of fittings, different ports on the same body (4, 104, 204, 304, 404) can have different fittings. In addition, one or more of the ports (10, 110, 210, 310, 410) may have the same type of fittings as the first fitting end (22, 122, 222, 322, 422).

Figure 10:
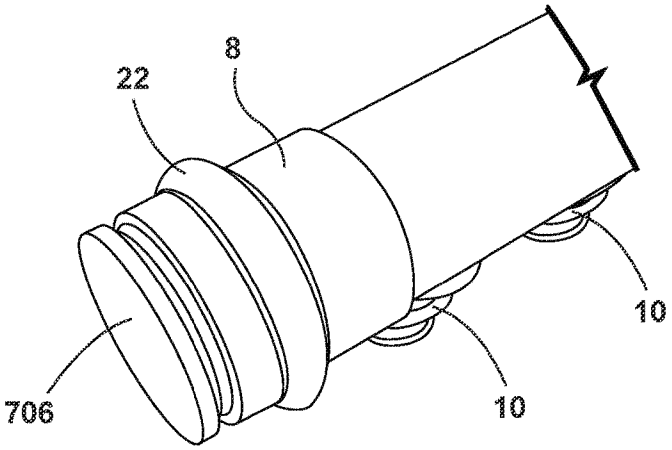
FIG. 10 is a partial front perspective view of the plug of FIG. 9 installed in the second end portion of the multi-port transition tee drain valve of FIG. 1.
Figure 9:
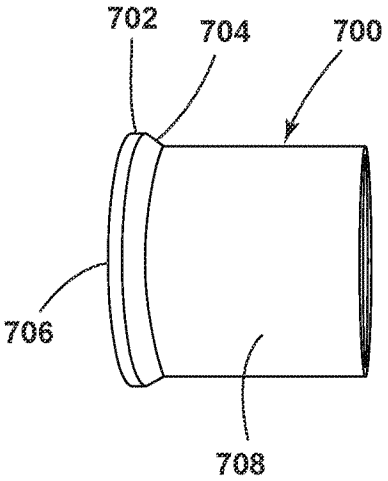
FIG. 9 is a front perspective view of a plug.
Figure 11:
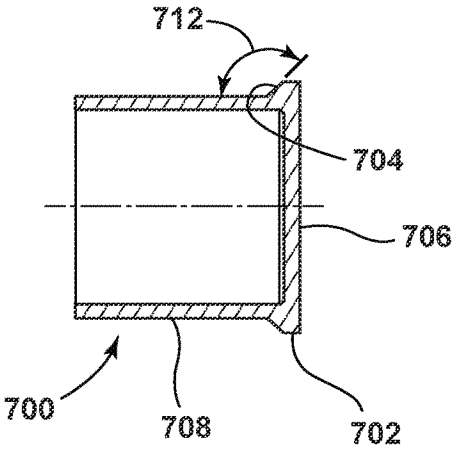
FIG. 11 is a cross-sectional view of the plug shown in FIG. 9.

A plug 700 can be coupled to the first fitting end 22 of the second end portion 8, as shown in FIG. 10. The plug 700 can also be coupled to the second fitting end 150. The plug 700 includes a generally cylindrical sidewall 708 and a generally cylindrical rim 702 that has a wider diameter than the generally cylindrical sidewall 708. A tapered surface 704 is positioned at the transition between the generally cylindrical sidewall 708 to the general cylindrical rim 702. The plug 700 includes an end surface 706. The angle 712 between the generally cylindrical sidewall 708 and the generally cylindrical rim 702 is in the range of 105° to 165°, and more preferably approximately 135°. The plug 700 can be made from any material, but is preferably made from brass. The plug 700 can be coupled to the fitting end (22, 150) by a pressing tool, allowing the user to cap off one of the ends of the body 404. The plug 700 can alternatively have a threaded surface that can couple to a threaded surface on the fitting end (22, 150).

In the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the present disclosure and other components is not limited to any specific material. Other exemplary embodiments of the disclosure disclosed herein may be formed from a wide variety of materials, unless described otherwise herein.

For purposes of this disclosure, the term "coupled" or "operably coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated. In addition, while certain embodiments have shown threaded connections, the threaded connections could include tape or other sealing material in the threaded connection. In addition, the threaded connection could be replaced by other suitable connections or couplings, such as compression couplings or other couplings.

For purposes of this disclosure, the term "connected" or "operably connected" (in all of its forms, connect, connecting, connected, etc.) generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the afore-mentioned structures and methods without departing from the concepts of the present invention, and further it is to be understood that such concepts are intended to be covered by the following claims unless these claims by their language expressly state otherwise.

The invention claimed is:

1. A multi-port tee drain valve, comprising:

a fitting body having a first end portion, a second end portion, a fluid passageway extending between said first end portion and said second end portion, and at least two ports located between said first end portion and said second end portion, said at least two ports positioned generally perpendicular to said fluid passageway;

a drain port located in said first end portion, said drain port having a centerline that is coaxial with the centerline of said fluid passageway;

a first fitting located in said second end portion, said first fitting having a centerline that is coaxial with the centerline of said fluid passageway;

a valve member located in said first end portion positioned in the fluid passageway between said drain port and said at least two ports; and said at least two ports having fitting ends.

2. The multi-port tee drain valve of claim 1, wherein said at least two ports is a pair of ports.

3. The multi-port tee drain valve of claim 1, wherein said at least two ports is three ports.

4. The multi-port tee drain valve of claim 1, wherein each of said at least two ports have the same type of fitting end.

5. The multi-port tee drain valve of claim 1, including a plug coupled to said second end portion of said fitting body.

6. The multi-port tee drain valve of claim 1, wherein said first fitting is a different type of fitting than said fitting ends of said at least two ports.

7. The multi-port tee drain valve of claim 1, wherein said fitting body is a single piece.

8. The multi-port tee drain valve of claim 7, wherein said valve member includes a valve housing that is integrally formed as part of said single piece fitting body, said valve housing include an opening for receiving a stem and a portion for positioning a ball within said fluid passageway.

9. A drain valve assembly, comprising:

a drain valve body having a first end portion with a drain port, a second end portion with a first fitting end, a fluid passageway extending between said first end portion and said second end portion, said fluid passageway having a centerline that is coaxial with the centerline of said drain port and said first fitting end, at least two ports located between said first end portion and said second end portion, said at least two ports being positioned generally perpendicular to said fluid passageway;

a valve member located in said first end portion of said fluid passageway positioned between said drain port and said at least two ports; and said at least two ports having fitting ends.

10. The drain valve assembly of claim 9, wherein said at least two ports is a pair of ports.

11. The drain valve assembly of claim 9, wherein said drain valve body is a single piece.

12. The drain valve assembly of claim 11, wherein said drain valve body includes a valve housing that is integrally formed as part of said single piece drain valve body, said valve housing including an opening for receiving a stem and a portion for positioning a ball within said fluid passageway.

13. The drain valve assembly of claim 9, including a plug coupled to a second end portion of said drain valve body.

14. The drain valve assembly of claim 9, wherein said first fitting end and said fitting ends of said at least two ports are different types of fitting ends.

15. The drain valve assembly of claim 9, wherein said drain port includes a removable cap.

16. A multi-port transition tee drain valve, comprising:

a drain valve body having a first end portion with a drain port, a second end portion with a first fitting end, a fluid passageway extending between said first end portion and said second end portion, said fluid passageway having a centerline that is coaxial with the centerline of said drain port and said first fitting end, at least two ports located between said first end portion and said second end portion, said at least two ports being positioned generally perpendicular to said fluid passageway;

a valve member located in said first end portion of said fluid passageway positioned between said drain port and said at least two ports; and said at least two ports having fitting ends that are different than said first fitting end.

17. The multi-port transition tee drain valve of claim 16, wherein said at least two ports is a pair of ports.

18. The multi-port transition tee drain valve of claim 16, wherein said at least two ports is three ports.

19. The multi-port transition tee drain valve of claim 16, wherein said drain valve body is a unitary piece.

20. The multi-port transition tee drain valve of claim 16, including a plug coupled to said second end portion of said drain valve body.

* * * * *